United States Patent [19]

Gongwer

[11] 4,004,308

[45] Jan. 25, 1977

[54] HYDRODYNAMIC STABILIZING DEVICE

[75] Inventor: Calvin A. Gongwer, Glendora, Calif.

[73] Assignee: The Bendix Corporation, North Hollywood, Calif.

[22] Filed: Mar. 11, 1976

[21] Appl. No.: 665,994

[52] U.S. Cl. ..... 9/8 R

[51] Int. Cl.[2] ..... B63B 21/52

[58] Field of Search ..... 9/8 R, 8.3 R, 8.3 E; 114/126; 340/2; 325/116

[56] References Cited

UNITED STATES PATENTS

| | | | |
|---|---|---|---|
| 3,453,670 | 7/1969 | Conry | 9/8 R |
| 3,500,209 | 3/1970 | Fletcher et al. | 9/8 R |
| 3,953,905 | 5/1976 | Paitson | 9/8 R |

*Primary Examiner*—Trygve M. Blix
*Assistant Examiner*—Jesus D. Sotelo
*Attorney, Agent, or Firm*—Robert C. Smith; William F. Thornton

[57] ABSTRACT

A stabilizing structure for a buoyant elongated cylindrical housing assembly is tethered to an anchor on the bottom of a body of water and includes a pair of positively buoyant arms hinged to the top of the housing at an angle to each other with leaf spring members and cables attached to the ends of the leaf spring members to limit the upward travel. The outwardly extending arms have an airfoil-like cross section and assume a trailing position relative to any current in the water with the current bisecting the angle between the arms. This arrangement causes the arms to exert a lifting force tending to both rotate the housing toward the vertical around its point of attachment with the tethering line attached to its lower end in opposition to the tilting force exerted by the current and also to positively lift the housing to a higher position more nearly over the anchor. A pair of tip fins may be used to counter forces tending to move the assembly in yaw. A pair of short strips may be attached along the sides of the housing to minimize vortex shedding effects.

6 Claims, 5 Drawing Figures

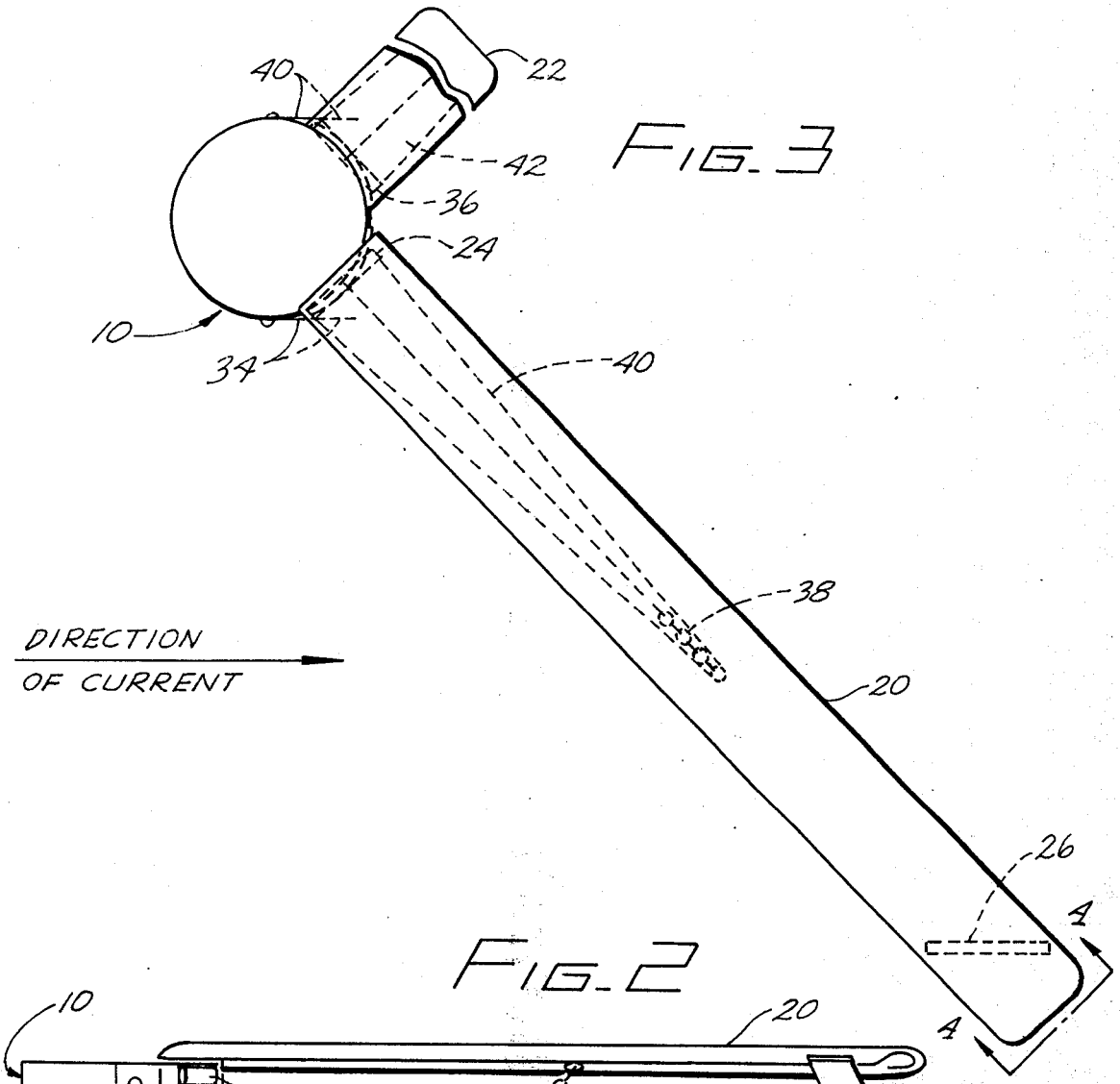
FIG. 3
FIG. 2
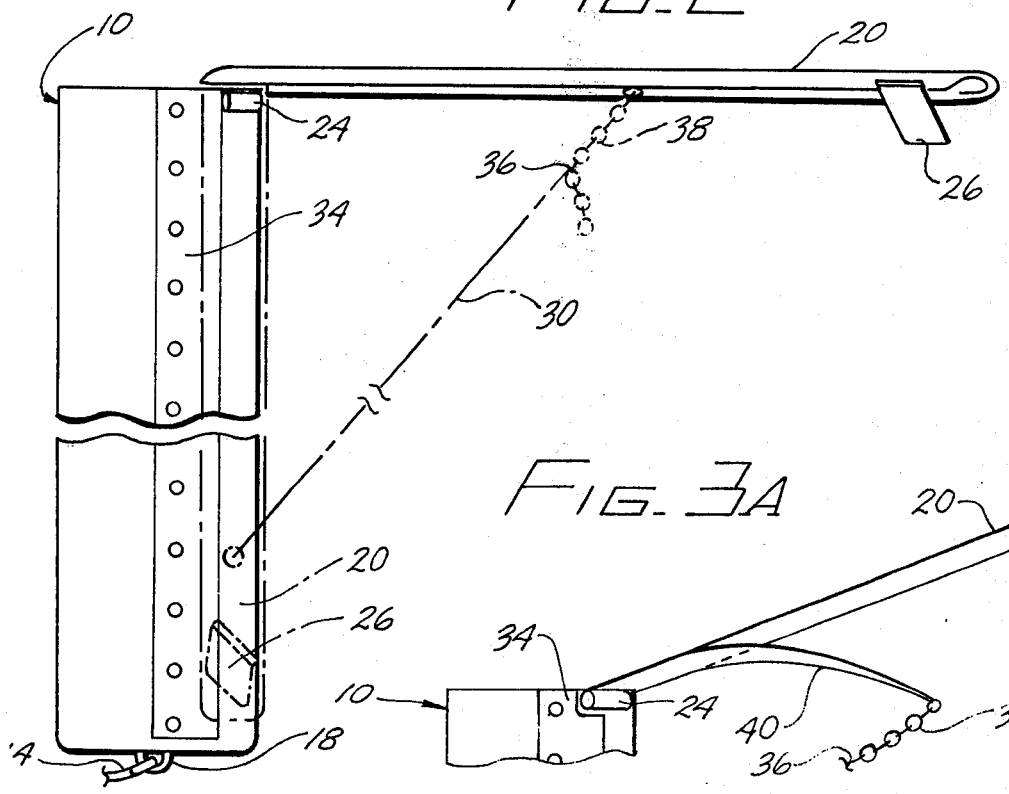
FIG. 3A
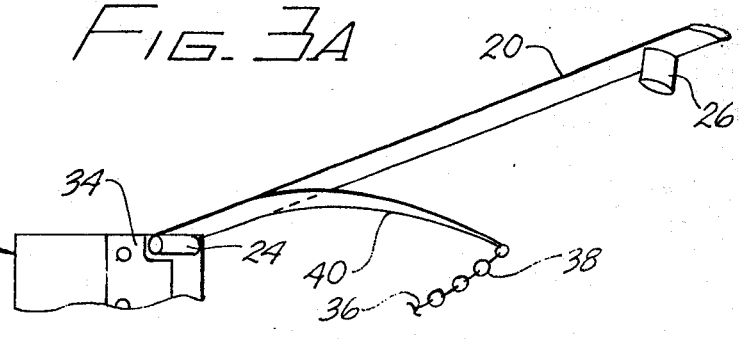

HYDRODYNAMIC STABILIZINGG DEVICE

The invention herein described was made in the course of or under a contract with the Navy Department.

BACKGROUND OF THE INVENTION

There are many applications for an underwater tethered buoy in which it is essential for highly desirable to maintain the verticality of the buoy despite the existence of substantial currents. In underwater transponders, for example, it is desirable to keep the upward-looking transducer as nearly vertical as possible. Such underwater currents normally tend to cause the buoy to oscillate, tilt or rotate around its point of attachment to its tethering lead. One way of minimizing such departures from the vertical is to provide such strong flotation that the vertical component from lift is much greater than the horizontal component from the current. This effect can be further improved if the effective area exposed to the lateral forces can be minimized. Even when this is done, however, the solution is only partial since the best that can be accomplished is an attitude representing the resultant of the vertical and horizontal forces. Two specific problems which have been experienced with buoys of this type having a swept wing system as described herein, when placed in significant currents, are vortex sheeding from the buoy and the coupling between yaw and roll oscillations. The roll oscillation around the center of gravity of the buoy is excited by vortex shedding from each end 180° out of phase from end to end. The lateral oscillation of the buoy and tether system around the anchor point on the ocean bottom appears also to contribute to roll oscillation.

It is therefore highly desirable to provide an arrangement where such underwater buoys can be maintained in a uniformly vertical attitude despite substantial variations in current. Thus, it may be desired to deploy such buoys in many locations with many different current conditions where there is little or no opportunity to make significant alterations in structure to assure verticality when anchored in location.

SUMMARY OF THE INVENTION

A laterally moving current is known to provide a force acting against the side of the buoy varying essentially with the square of the velocity of such current. This is an overturning force tending to cause the buoy to rotate around its point of contact with its tethering line. By attaching to the top of the cylindrical buoy a pair of upward swinging arms whose hinges are located at a substantial angle with respect to the direction of the current and whose cross-section is similar to an airfoil, a lifting force is developed which is also proportional to the square of the current velocity and which tends to cause the buoy to rotate around its point of attachment with its tethering line in the opposite direction from the overturning force described above. With proper dimensions of such arms or "wings" this lifting force not only causes the buoy to maintain essential verticality but tends to cause the buoy to use the force imparted by the current to "fly" upwardly closer to a vertical position over the anchor.

The laterally extending arms also provide roll damping, and with the swept back angle of the arms at 45° from the direction of the current the damping in pitch becomes identical to the roll damping. Yaw damping is somewhat more complicated since any given yaw velocity advances one wing tip and retards the other, causing the respective lifts to increase and decrease, resulting in a large roll moment. This combined yaw and roll oscillation is known as "Dutch Roll" oscillation. To control this effect, one can arrange the mounting of the extending arms or wings to provide a significant vertical component through dihedral angle. Alternatively, one can provide wing tip fins, as illustrated herein, which are effective to damp out any moments tending to cause the cylindrical, vertically-oriented buoy to rotate around its axis. The chamber in the tip fins provides equal and opposite steady side forces which cancel and is provided to enable the fins to fold smoothly against the body of the buoy.

Since the wings described are effective to cause the buoy to hold an essentially fixed orientation with the current, the use of stub strips or tabs can be used, where desirable, to produce a smoother flow regime in which vortex shedding is minimized. These stub strips or tabs are of light springy sheet metal or flexible plastic which are fastened across from each other along the side of the cylindrical buoy and which are flexible enough to fold against the surface of the buoy during handling, but while will spring away from the side of the buoy when it is deployed.

DESCRIPTION OF THE DRAWINGS

FIG. 2 is a side view of the buoy of FIG. 1;

FIG. 3 is a partial top view of the buoy of FIGS. 1 and 2;

FIG. 3A is a partial side view of the buoy as shown in FIG. 2 in a different operating position.

DESCRIPTION OF THE PREFERRED EMBODIMENT

Figure 1:
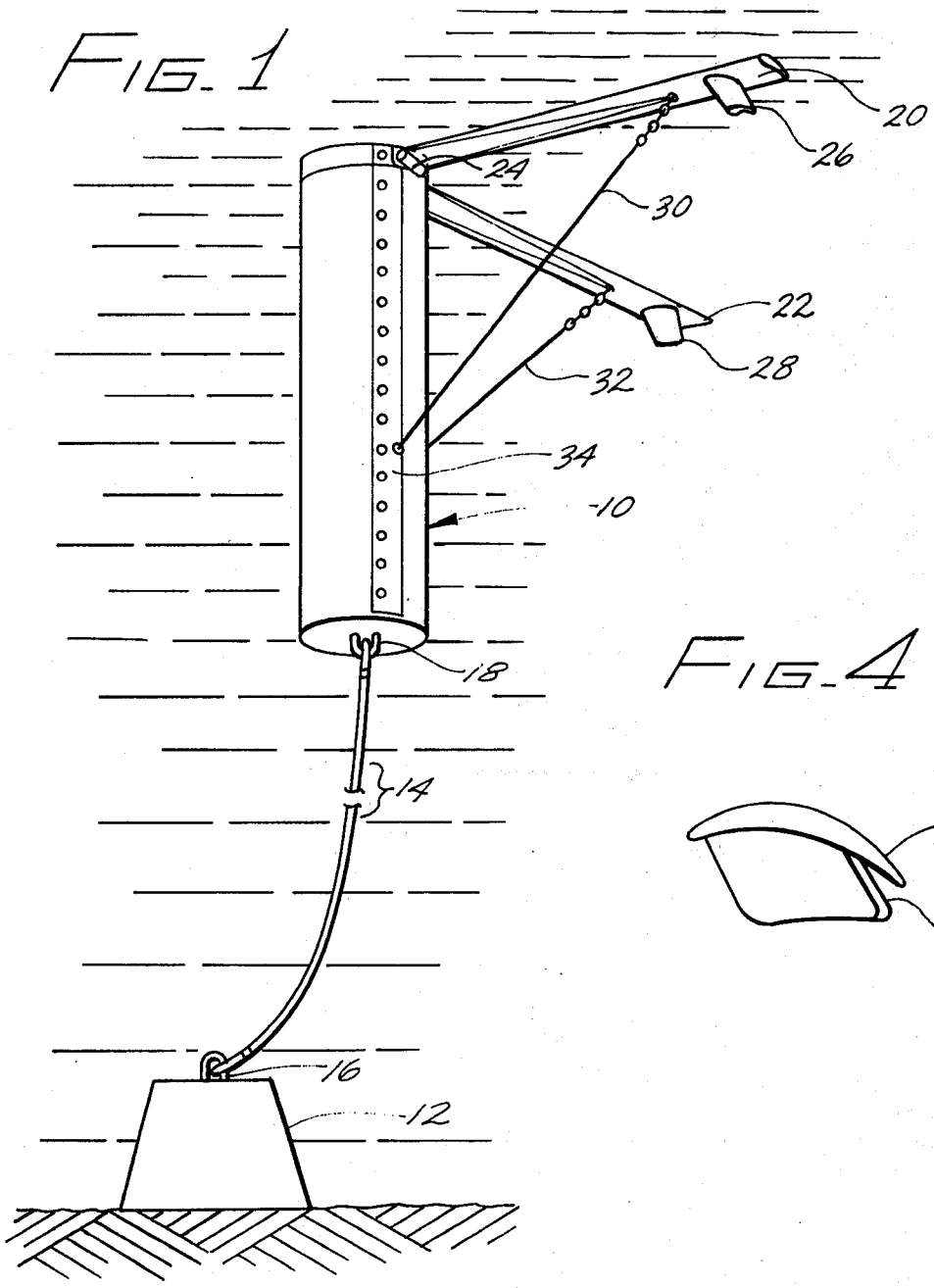
FIG. 1 is a plan view, partly in perspective, of an underwater buoy and anchor according to my invention in deployed position.

FIG. 1 shows a generally cylindrical buoyant housing 10 which is tethered to an anchor 12 by means of a suitable line 14. Line 14 is attached to anchor 12 at a mounting member 16 and to the buoy 10 by means of a loop carried in a U-shaped fastening member 18. Pivotally attached at the top of buoy 10 are a pair of positively buoyant radially extending wings or arms 20 and 22 which are fastened to buoy member 10 by means of suitable hinges, hinge 24 being visible in FIG. 1. Near the outboard ends of members 20 and 22 are a pair of tip fins 26 and 28, respectively. To limit the normal travel of the members 20 and 22 around their respective hinges, a pair of cables 30 and 32, respectively, are employed which are normally carried within the buoy 10 before the buoy is deployed and which, after deployment, are extended as shown. A plastic or sheet metal strip or tab 34 is fastened to the side of buoy 10 as shown, and a similar tab is present on the other side of the buoy, as will be discussed below.

Some further details of the structure shown in FIG. 1 appear in FIG. 2 which is a partial side view of the buoy 10 shown with one of the extendible arms or wings 20 extended and which is rotatable around and supported at the inboard end by means of a hinge 24. Upward movement of the outboard end of arm 20 is limited by means of the cable 30 which terminates in a hook 36 which may be selectively attached to any of a number of links in a chain 38 depending from the arm 20. By varying the effective length of cable 30 and chain 38 as indicated, the effective dihedral angle of wing 20 and its counterpart wing 22 may be varied to trim the riding attitude. When wing 20 is folded down against the side of buoy 10 during handling, it assumes a position as shown in dash-dot outline. Similarly, the tip fin 26 folds under the arm 20 and against the side of buoy 10 as shown. As arm 20 folds down, it also tends to urge the tab 34 tightly against the side of buoy 10.

FIG. 3 is a top view of the structure shown in FIGS. 1 and 2 with the arms 20 and 22 extended and arm 22 truncated. Hinges 24 and 36 are shown in dotted outline below the surface of the arms 20 and 22, respectively. Similarly, a portion of the edges of the tabs 34 and 40 is also shown dotted since they are actually under the arms 20 and 22.

Also visible in dotted outline beneath arms 20 and 22 are a pair of leaf spring members 40 and 42. Since the amount of lift provided by arms or wings 20 and 22 is specifically known and designed for with respect to a maximum allowable current, the occurrence of a substantially higher current may tend to produce excessive lift and loading on the tether 14 and cause anchor dragging. To reduce the lift in the presence of such substantially higher currents, the arms 20 and 22 may be permitted to continue to rise above a normal operating angle as shown in FIG. 3A to reduce the angle of attack of the wing with the flow direction. Arm 20 is moved upwardly against the spring action of member 40. Member 40, however, is limited in its travel since its outboard end is confined by means of chain 38 and cable 30. As arms 20 and 22 lift into positions such as shown in FIG. 3A, their effective lifting force on buoy 10 is reduced with increases in the current velocity. Thus, current velocities above a given value will result in having the arms or wings moved upwardly to a position where they supply less lift.

Figure 4:
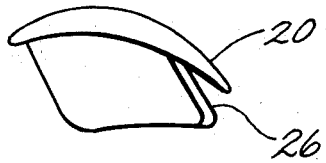
FIG. 4 is a view taken along lines 4—4 of FIG. 3.

FIG. 4 is an end view looking along line 4—4 of FIG. 3 and shows the wing tip fin 26 in deployed position relative to arm 20. From the top view, FIG. 3, it will be apparent that tip fins 26 and 28 (see FIG. 1) present a flat side resisting any moment tending to rotate housing 10 around its axis.

A number of modifications are possible within the scope of the present invention. While the arms are shown in a trailing position at an angle of 90° from each other, and while this is a preferred relationship because it tends to produce equal damping in pitch and roll as set forth above, for other applications this angle may not be critical. Also, for some applications the use of a dihedral angle of the arms may eliminate the need for the tip fins.

I claim:

1. A stabilizing structure for an elongated, generally cylindrical housing to be deployed into a body of water having a current, including an anchor and tethering means connecting said housing to said anchor, a pair of positively buoyant arms hinged to said housing near the top thereof and movable between a first position folded against the side of said housing and a second position extended outwardly from said side, said arms having an airfoil-like cross-section capable when extended into said current of imparting lift to said arms and to said housing, said arms being extended at an angle between each other with the current direction effectively bisecting said angle, resilient means also extending outwardly along the under side of said arms, and cable means extending outwardly from said housing toward said arms and fastened to said resilient means.

2. A stabilizing structure for an elongated, generally cylindrical housing as set forth in claim 1 wherein means are included for adjusting the length of said cable means.

3. A stabilizing structure for an elongated, generally cylindrical housing as set forth in claim 1 wherein small substantially vertically depending fins are attached to the outboard ends of said arms.

4. A stabilizing structure for an elongated, generally cylindrical housing as set forth in claim 3 wherein said fins are hinged to said arms at an angle such that when said housing is deployed said fins present their narrowest dimension toward the current.

5. A stabilizing structure for an elongated, generally cylindrical housing as set forth in claim 1 wherein said resilient means comprise leaf spring members.

6. A stabilizing structure for an elongated, generally cylindrical housing as set forth in claim 1 wherein longitudinal tabs are provided attached at one edge and tangent to the cylinder and extending aft with respect to the direction of said current.

* * * * *